US006530534B1

(12) United States Patent
Farmer

(10) Patent No.: US 6,530,534 B1
(45) Date of Patent: Mar. 11, 2003

(54) PNEUMATIC COMMINUTION AND DRYING SYSTEM

(75) Inventor: Bobby Joe Farmer, Waco, TX (US)

(73) Assignee: Lee McGrath, Portland, OR (US)

( * ) Notice: Subject to any disclaimer, the term of this patent is extended or adjusted under 35 U.S.C. 154(b) by 0 days.

(21) Appl. No.: 09/660,773

(22) Filed: Sep. 13, 2000

Related U.S. Application Data

(60) Provisional application No. 60/153,210, filed on Sep. 13, 1999.

(51) Int. Cl.[7] ..... B02C 19/06

(52) U.S. Cl. ..... 241/5; 241/19; 241/39; 241/79.1

(58) Field of Search ..... 241/5, 39, 40, 241/79.1, 19

(56) References Cited

U.S. PATENT DOCUMENTS

| | | | | |
|---|---|---|---|---|
| 2,515,541 A | | 7/1950 | Yellott | 241/39 |
| 2,885,154 A | | 5/1959 | Eastman et al. | 241/5 |
| 3,643,875 A | | 2/1972 | Dille et al. | 241/5 |
| 3,876,156 A | * | 4/1975 | Muschelknautz et al. | 241/40 |
| 4,264,352 A | | 4/1981 | Houser | |
| 4,390,131 A | | 6/1983 | Pickrel | |
| 5,402,947 A | | 4/1995 | Petersen | 241/39 |
| 5,598,979 A | | 2/1997 | Rowley, Jr. | 241/5 |

FOREIGN PATENT DOCUMENTS

| | | |
|---|---|---|
| WO | WO 98/35756 | 8/1998 |

* cited by examiner

*Primary Examiner*—Mark Rosenbaum
(74) *Attorney, Agent, or Firm*—Moser, Patterson & Sheridan, LLP.

(57) ABSTRACT

Apparatus and method of comminuting materials are provided. In one embodiment, the comminution/drying apparatus comprises a comminution/drying cyclone having an input and an output, a blower having a blower output connected to the input of the comminution/drying cyclone, a material feed connected to the input of the comminution/drying cyclone, and a separation cyclone having an inlet connected to the output of the comminution/drying cyclone, the separation cyclone having a material discharge and an air outlet. In another embodiment, the comminution apparatus comprises a comminution cyclone having an input and an output, a blower having a blower output connected to the input of the comminution cyclone, a material feed connected to the input of the comminution cyclone, and a wet filtration system having an inlet, a material discharge and an air exhaust, the inlet of the wet filtration system connected to the output of the comminution cyclone.

27 Claims, 3 Drawing Sheets

PNEUMATIC COMMINUTION AND DRYING SYSTEM

This application claims benefit to U.S. Provisional Application Ser. No. 06/153,210 filed Sep. 13, 1999.

BACKGROUND OF THE INVENTION

1. Field of the Invention

The invention generally relates to comminution/drying systems. More particularly, the invention relates to a pneumatic comminution/drying system.

2. Background of the Related Art

Various comminution system have been developed for breaking down various materials into smaller particles. Typical methods utilized for comminuting materials include grinding, cutting, and hammering. However, typical comminution systems do not provide satisfactory throughput and/or efficiency. Furthermore, to provide dry comminuted particles, typical comminution systems require a heat source, such as a furnace, to thermally evaporate the moisture content in the materials or the comminuted particles, which further increases the cost for the comminution process and reduces the throughput and efficiency of the comminution system. Therefore, there remains a need for a comminution system that improves throughput and efficiency in producing dry comminuted particles. It would be further desirable for the comminution system to be easily scaled up or down to accommodate various materials and/or throughput and efficiency requirements.

SUMMARY OF THE INVENTION

Apparatus and method of comminuting materials are provided. One aspect of the invention provides a comminution system that improves throughput and efficiency in producing dry comminuted particles. The comminution system may be easily scaled up or down to accommodate various materials and/or throughput and efficiency requirements.

In one embodiment, the comminution apparatus comprises a comminution cyclone having an input and an output, a blower having a blower output connected to the input of the comminution cyclone, a material feed connected to the input of the comminution cyclone, and a separation cyclone having an inlet connected to the output of the comminution cyclone, the separation cyclone having a material discharge and an air outlet.

In another embodiment, the comminution apparatus comprises a comminution cyclone having an input and an output, a blower having a blower output connected to the input of the comminution cyclone, a material feed connected to the input of the comminution cyclone, and a wet filtration system having an inlet, a material discharge and an air exhaust, the inlet of the wet filtration system connected to the output of the comminution cyclone.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Generally, embodiments of the invention utilizes a pneumatic comminution process in which high velocity air is used to pulverize and dry a wide range of non-malleable materials. The high velocity air carries the materials to be processed into a comminution cyclone which pulverizes the materials as the materials collide with one another and with comminution bars disposed on the interior surface of the cyclone. The comminution cyclone also dries the materials (i.e., separates liquid particles from solid particles) with centrifugal force as the material circulate inside the cyclone. In one embodiment, the processed materials or comminuted particles (e.g., liquid aerosols and dry particles) are transferred into a second cyclone (i.e., separation cyclone) which separates the dry particles from the liquid aerosols. The dry particles fall to a bottom portion of the separation cyclone and are removed through an airlock material discharge. The liquid aerosols are exhausted through an air outlet disposed at a top portion of the separation cyclone and may be filtered through a filtration system.

Figure 1:
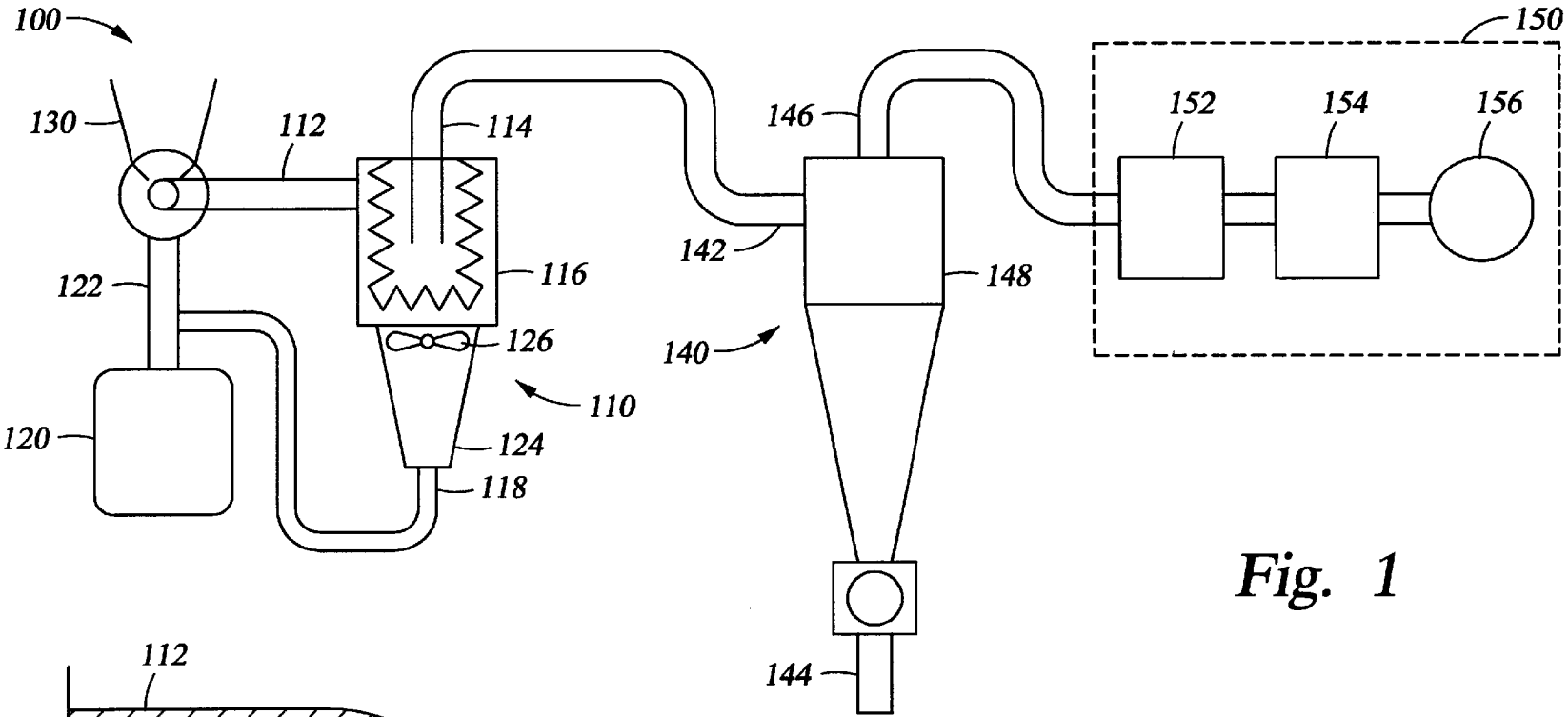
FIG. 1 is a schematic diagram of one embodiment of a pneumatic comminution/drying system of the invention.

FIG. 1 is a schematic diagram of one embodiment of a pneumatic comminution/drying system of the invention. The pneumatic comminution/drying system 100 generally comprises a comminution/drying cyclone 110, a blower 120, a material feed 130, and a separation cyclone 140. The comminution/drying cyclone 110 includes an input 112 and an output 114. A blower output 122 of the blower 120 is connected to the input 112 of the comminution/drying cyclone 110. The material feed 130 is also connected to the input 112 of the comminution/drying cyclone 110. The output 114 of the comminution/drying cyclone 110 is connected to an inlet 142 of the separation cyclone 140. The separation cyclone 140 includes a material discharge 144 and an air outlet 146.

Figure 2:
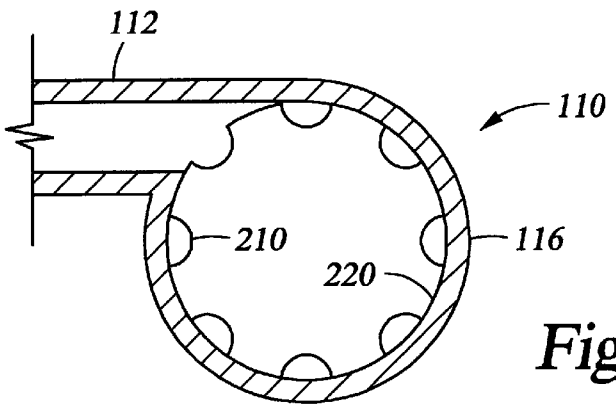
FIG. 2 is a cross sectional top view of one embodiment of a comminution/drying cyclone.

The comminution/drying cyclone 110 may comprise a cylindrical body 116 made of a metal, such as stainless steel, having a plurality of comminution bars disposed longitudinally on an interior surface of the cylindrical body 116. FIG. 2 is a cross sectional top view of one embodiment of a comminution/drying cyclone. As shown in FIG. 2, the comminution bars 210 may comprise a metal such as stainless steel and are disposed in a spaced arrangement on an interior surface 220 of the cylindrical body 116. Each comminution bar 210 may be removably attached to the interior surface 220 of cylindrical body 116, for example, by fasteners such as bolts or screws. Alternatively, each comminution bar 210 may be slidably disposed in a holding groove. The comminution bars 210 may be replaced periodically.

Referring to FIGS. 1 and 2, the cylindrical body 116 may be disposed on a substantially vertical axis, and the input 112 of the comminution/drying cyclone 110 may be connected substantially tangentially to the cylindrical body 116. A blower output 122 of the blower 120 is connected to the input 112 of the comminution/drying cyclone 110 and provides air flow into the comminution/drying cyclone 110. In one embodiment, the blower provides air flow from about 5,000 $ft^3$/min to about 20,000 $ft^3$/min to the input of the comminution/drying cyclone. In another embodiment, the blower provides air flow of about 10,000 $ft^3$/min to the input of the comminution/drying cyclone, which may provide air speeds inside the cyclone between about 600 mph to about 800 mph.

The comminution/drying cyclone 110 may further comprise an air input 118 disposed at a bottom portion of the comminution/drying cyclone 110. The air input 118 is connected to the blower output 122 so that materials that have fallen to the bottom portion of comminution/drying cyclone 110 may be blown upwardly and comminuted. The bottom portion of the comminution/drying cyclone 110 may comprise a funnel-shaped body 124, and the air input may be disposed at the tip portion of the funnel-shaped body 124. Alternatively, to drive fallen particles upwardly in the comminution/drying cyclone 110, an impeller 126 may be disposed at a bottom portion of the comminution/drying cyclone.

The output 114 of the comminution/drying cyclone 110 may be disposed substantially centrally at a top portion of the cylindrical body 116. The size (i.e., diameter) of the output 114 of the comminution/drying cyclone 110 may be utilized to control the size of the comminuted particles output from the comminution/drying cyclone 110. Generally, for a specified amount of air flow from the blower and amount of material introduced into the system from the material feed 130, the size of the comminuted particles output from the comminution/drying cyclone 110 decreases as the diameter of the output 114 increases. In one embodiment, to provide comminuted particles having diameters from a few (<100) micrometers to less than one micrometer, the diameter of the output 114 is about 24 inches for a comminution/drying cyclone 110 having an internal radius of about 18 inches and an internal volume of about 20 $ft^3$ attached to a blower providing about 10,000 $ft^3$/min to the input of the comminution/drying cyclone. A comminution system having this volume may achieve up to 10 tons of materials processed per hour.

The output 114 of the comminution cyclone 110 is connected to an inlet 142 of the separation cyclone 140. The separation cyclone 140 may comprise a cylindrical body 148 having the inlet 142 disposed substantially tangentially to the cylindrical body 148 to provide air flow into the cylindrical body 148. The comminuted particles output from the comminution/drying cyclone 110 include liquid aerosols and dry microparticles, and the liquid aerosols are separated from the dry microparticles in the separation cyclone 140. The liquid aerosols are exhausted through the air outlet 146 disposed at a top portion of the cylindrical body 148 while the dry microparticles are discharged through the material discharge 142 disposed at the bottom portion of the separation cyclone 140. The material discharge 142 of the separation cyclone 140 may comprise a rotary air lock discharge.

A filtration system 150 may be connected to the air outlet 146 of the separation cyclone 140. As shown in FIG. 1, the filtration system 150 may comprise a de-mister 152, a bag house 154, and optionally, an exhaust fan 156. Alternatively, a wet filtration system may be utilized to filter the liquid aerosols exhausted from the air outlet 146 of the separation cyclone 140.

In a comminution/drying system for producing dry discharged materials, the material to be processed is introduced into the material feed 130, such as a hopper, disposed above input 112 of the comminution/drying cyclone 110. The input 112 may comprise an injector pump which introduces the material into the high velocity air stream produced by the blower 120. The blower 120 may comprise a centrifugal fan, a multistage centrifugal fan, or a rotary, positive displacement blower. The material to be processed is then delivered into the comminution/drying cyclone 110. To facilitate grinding, half-round comminution bars 210 are attached inside the cyclone at spaced intervals, for example, at approximately four-inch intervals. As the material circulates in the comminution/drying cyclone 110, the particles impinge upon each other and upon the comminution bars 210. The particles are continually broken down into smaller particles until the particle cross-sectional area-to-mass ratio is small enough to permit the particles to exit through the output 114 at the top of the comminution/drying cyclone 110. The final particle size may be adjusted by the design parameters of the system, which include the air velocity and the size of the discharge tube (output 114) at the top of the cyclone.

During the time the material is circulating inside the cyclone, the combination of the centrifugal fore and the force of the high velocity air on the particles causes moisture in the material to be removed in the form of aerosol particles. This "drying" is accomplished without the use of heat, thereby saving the cost of thermal energy necessary to vaporize the liquid. The degree of dryness to be achieved by the system may be adjusted by increasing or decreasing the loading rate of materials and the residence time of the material in the grinding/drying cyclone.

Very wet materials may "glob" and build up in the bottom of the comminution/drying cyclone. This problem may be solved by introducing air flow through the air input 118 at the bottom of the comminution/drying cyclone. This upward flow of air reduces the tendency of the material to drop to the bottom of the cyclone. Alternatively, an impeller 126 may be installed at the bottom of the comminution/drying cyclone. As clumps of material fall to the bottom, the impeller causes the clumps to be broken up and reintroduced into the rotating airflow in the cyclone.

After the particles are reduced to the desired size, the comminuted and dried particles leaves the comminution/drying cyclone and enter the separation cyclone 140 where the liquid aerosols are separated from the dry particles. Since some dust will accompany the aerosols as the aerosols exit the top of the separation cyclone 140, filtering or scrubbing of the air may be necessary before the air can be exhausted. The filtering may be accomplished by a bag house or a venturi wet scrubber. The dried and pulverized particles then drop to the bottom of the separation cyclone 140 and is discharged through a rotary airlock.

Figure 3:
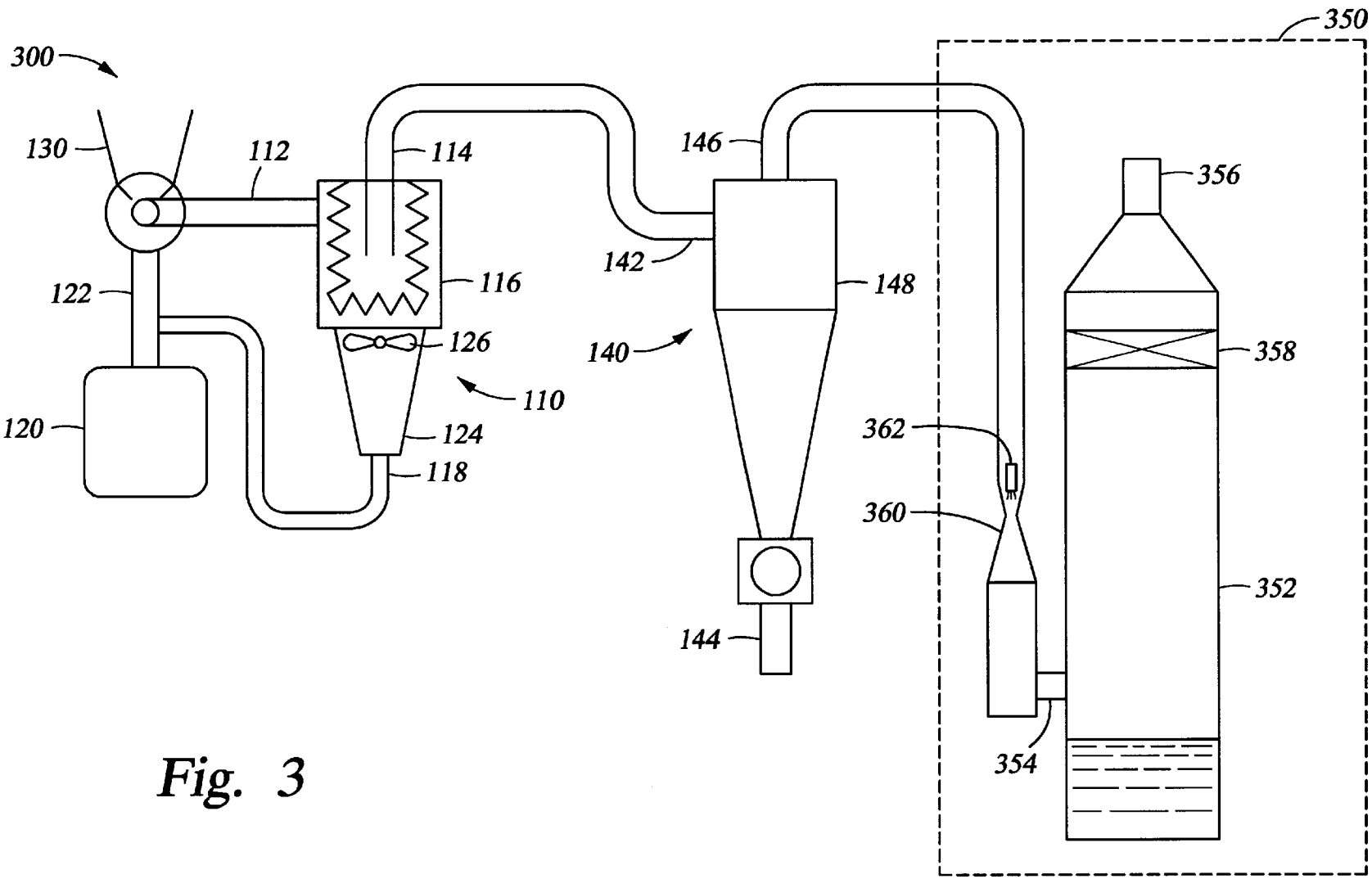
FIG. 3 is a schematic diagram of another embodiment of a pneumatic comminution/drying system of the invention.

FIG. 3 is a schematic diagram of an embodiment of a pneumatic comminution/drying system 300 having a wet filtration system 350 connected to the air outlet of the separation cyclone. Except for the wet filtration system 350, the other components of the pneumatic comminution/drying system 300 may be similar to those described for the pneumatic comminution/drying system 100 as shown in FIG. 1. An example of a wet filtration system may comprise a venturi (type) wet scrubber (e.g., a direct contact heat exchanger). As shown in FIG. 3, the wet filtration system 350 may comprise a container body 352 having a container inlet 354 disposed in a middle portion and an air exhaust 356 disposed in an upper portion. A de-mister 358 may be disposed in the container body 352 between the container inlet 354 and the air exhaust 356. A venturi connection 360 may be disposed between the air outlet 146 of the separation cyclone 140 and the container inlet 354, and a fluid distributor 362, such as a spray nozzle, may be disposed adjacent or above the venturi connection 360 to wet the aerosols and dust particles output from the air outlet 146 of the separation cyclone 140.

Figure 4:
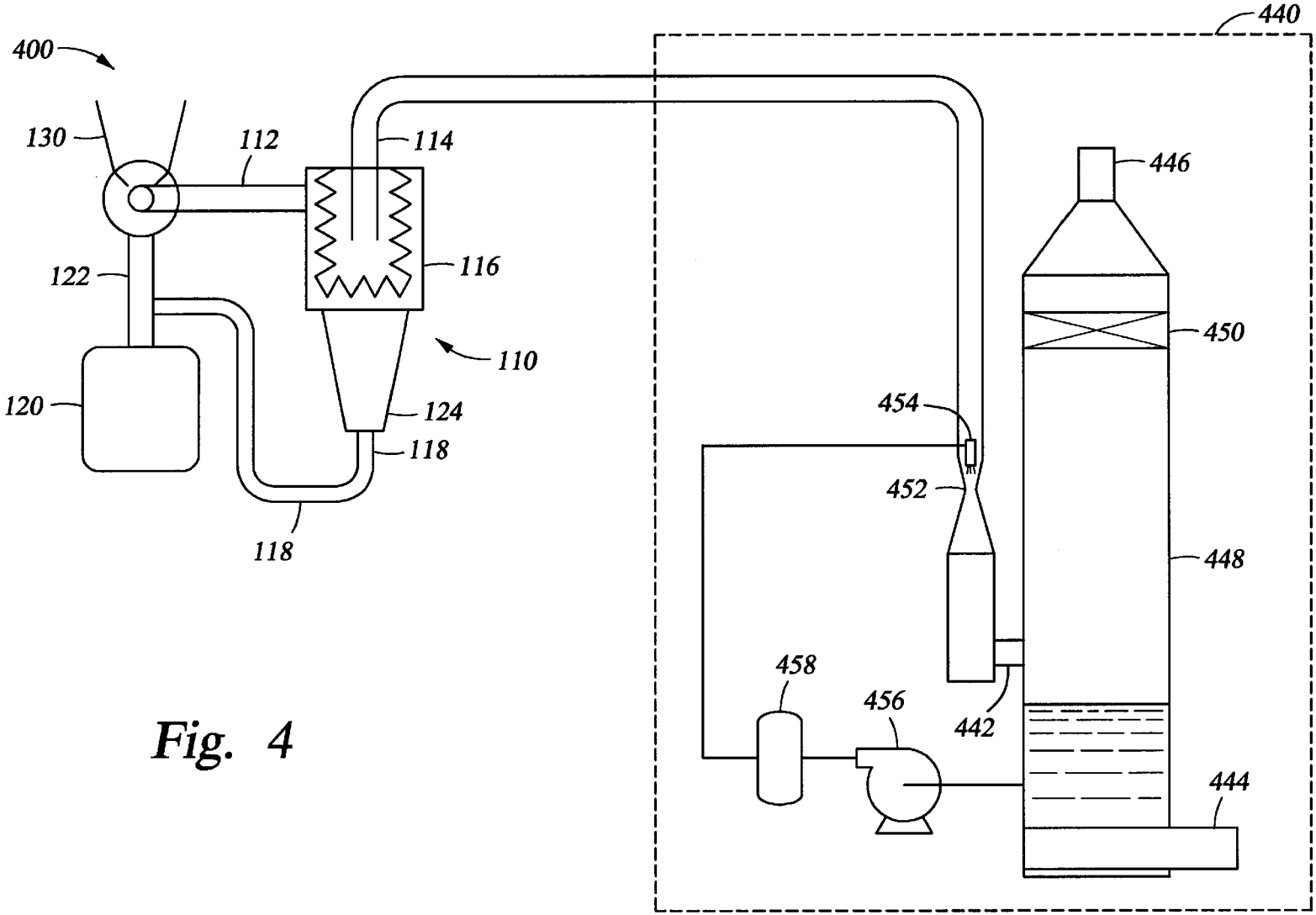
FIG. 4 is a schematic diagram of another embodiment of a pneumatic comminution system of the invention.

FIG. 4 is a schematic diagram of another embodiment of a pneumatic comminution system 400 of the invention. The pneumatic comminution system 400 may be utilized to provide wet solid discharge and may be particularly useful for precious metal mining processes. The pneumatic comminution system 400 generally comprises a comminution cyclone 110, a blower 120, a material feed 130, and a wet filtration system 440. The components and operation of the comminution cyclone 110, the blower 120 and the material feed 130 are described above with respect to similar components as shown in FIG. 1. The output 114 of the comminution cyclone 110 is connected to an inlet 442 of the wet filtration system 440. The wet filtration system 440 includes a material discharge 444 and an air exhaust 446. An example of a wet filtration system is a venturi (type) wet scrubber.

As shown in FIG. 4, the wet filtration system 440 may comprise a container body 448 having the air exhaust 446 disposed in an upper portion, the inlet 442 disposed in a middle portion, and the material discharge 444 disposed in a lower portion. A de-mister 450 may be disposed in the container body 448 between the inlet 442 and the air exhaust 446. A venturi connection 452 may be disposed between the output 114 of the comminution cyclone 110 and the inlet 442, and a liquid distributor 454, such as a spray nozzle, may be disposed adjacent the venturi connection 452. The comminuted particles output from the comminution cyclone 110 are sprayed with a desired wetting agent or chemical mixture/solution to provide desired separation of comminuted microparticles. The wet solid discharge is removed from the wet filtration system 440 through a bottom portion of the container body 448. An auger may be utilized to facilitate removal of wet solid discharge from the system.

A circulation pump 456 may be connected to draw liquid from the middle portion of the container body 448 and recycle the fluids used in the wet filtration system 440. The circulation pump 456 may be connected to provide fluids back to the liquid distributor 454. A basket filter 458 may be disposed between the circulation pump 456 and the liquid distributor 454 to filter undesirable particles from the recycled fluids.

In a comminution system for producing wet discharged materials, the process is basically the same through the time the material is discharged from the comminution/drying cyclone 110 (as described above). Drying is not relevant to the wet discharged material process, and thus, the separation cyclone is not required. The air stream carrying the pulverized particles then enters the wet filtration system 440 (e.g., wet scrubber), where the comminuted particles are thoroughly mixed with a liquid or chemical solution. For example, for removing precious metal particles, the comminuted particles are wetted with a reagent for removing precious metals. Typically, the reagent causes the precious metal to be separated from other unwanted particles and be easily collected. The liquid may be recirculated through a basket filter or a hydrocyclone for the removal of undesired particles before the liquid is subsequently returned to the spray nozzles in the venturi at the entrance of the wet scrubber. The comminuted particles may be removed from the bottom of the scrubber by an auger and, if desired, discharged through a hydrocyclone to lower the moisture content of the solids.

While the foregoing is directed to the preferred embodiment of the present invention, other and further embodiments of the invention may be devised without departing from the basic scope thereof, and the scope thereof is determined by the claims that follow.

What is claimed is:

1. A comminution/drying apparatus, comprising:

a comminution/drying cyclone comprising an input, an output, a cylindrical body having a plurality of comminution bars disposed longitudinally on an interior surface of the cylindrical body, and an air input disposed at a bottom portion of the comminution/drying cyclone, the air input connected to a blower output;

a blower having the blower output, the blower output being connected to the input of the comminution/drying cyclone;

a material feed connected to the input of the comminution/drying cyclone; and a separation cyclone having an inlet connected to the output of the comminution/drying cyclone, the separation cyclone having a material discharge and an air outlet.

2. The apparatus of claim 1 wherein the bottom portion of the comminution/dying cyclone comprises a funnel-shaped body.

3. A method for comminuting materials, comprising:

providing air flow from a blower having a blower output connected to an input of a communication/drying cyclone;

supplying materials through a material feed connected to the input of the comminution/drying cyclone;

transporting comminuted materials to a separation cyclone having an inlet connected to an output of the comminution cyclone;

filtering air from an air outlet of the separation cyclone, wherein air from the air outlet of the separation cyclone is filtered through a de-mister and a bag house; and discharging separated materials through a material discharge of the separation cyclone.

4. A comminution apparatus, comprising:

a comminution cyclone having an input and an output;

a blower having a blower output connected to the input of the comminution cyclone;

a material feed connected to the input of the comminution cyclone; and a wet filtration system having an inlet, a material discharge and an air exhaust, the inlet of the wet filtration system connected to the output of the comminution cyclone.

5. The apparatus of claim 4 wherein the wet filtration system comprises a venturi wet scrubber.

6. The apparatus of claim 4 wherein the wet filtration system comprises:

a container body having the air exhaust disposed in an upper portion, the inlet disposed in a middle portion, and the material discharge disposed in a lower portion;

a de-mister disposed in the container body between the inlet and the air exhaust;

a venturi connection disposed between the output of the comminution cyclone and the inlet; and a liquid distributor disposed adjacent the venturi connection.

7. The apparatus of claim 6, further comprising:

a circulation pump connected to draw liquid from the middle portion of the container.

8. The apparatus of claim 7, wherein the circulation pump is connected to provide liquid to the liquid distributor.

9. The apparatus of claim 8, further comprising:

a basket filter disposed between the circulation pump and the liquid distributor.

10. The apparatus of claim 4 wherein the comminution cyclone comprises a cylindrical body having a plurality of comminution bars disposed longitudinally on an interior surface of the cylindrical body.

11. The apparatus of claim 10 wherein the plurality of comminution bars comprise one or more removable bars.

12. The apparatus of claim 10 wherein the cylindrical body is disposed on a substantially vertical axis and the input of the comminution cyclone is connected substantially tangentially to the cylindrical body.

13. The apparatus of claim 12 wherein the output of the comminution cyclone is disposed substantially centrally at a top portion of the cylindrical body.

14. The apparatus of claim 10 wherein the comminution cyclone further comprises an air input disposed at a bottom portion of the comminution cyclone, the air input connected to the blower output.

15. The apparatus of claim 14 wherein the bottom portion of the comminution cyclone comprises a funnel-shaped body.

16. The apparatus of claim 10 further comprises an impeller disposed at a bottom portion of the comminution cyclone.

17. A method for comminuting materials, comprising:

providing air flow from a blower having a blower output connected to an input of an comminution cyclone;

supplying materials through a material feed connected to the input of the comminution cyclone; and filtering comminuted materials through a wet filtration system having an inlet connected to the output of the comminution cyclone; and removing wet filtered materials through a material discharge of the wet filtration system.

18. The method of claim 17, further comprising:

exhausting air through a de-mister of the wet filtration system.

19. The method of claim 17 wherein the comminuted materials are filtered through a venturi wet scrubber.

20. The method of claim 17 wherein the blower provides air flow from about 5,000 $ft^3$/min to about 20,000 $ft^3$/min to the input of the comminution cyclone.

21. The method of claim 17 wherein the blower provides air flow of about 10,000 $ft^3$/min to the input of the comminution cyclone.

22. A comminution/drying apparatus, comprising:

a comminution/drying cyclone having an input and an output;

a blower having a blower output connected to the input of the comminution/drying cyclone;

a material feed connected to the input of the comminution/drying cyclone;

a separation cyclone having an inlet connected to the output of the comminution/drying cyclone, the separation cyclone having a material discharge and an air outlet; and an impeller disposed at a bottom portion of the comminution/drying cyclone.

23. A comminution/drying apparatus, comprising:

a comminution/drying cyclone having an input and an output;

a blower having a blower output connected to the input of the comminution/drying cyclone;

a material feed connected to the input of the comminution/drying cyclone;

a separation cyclone having an inlet connected to the output of the comminution/drying cyclone, the separation cyclone having a material discharge and an air outlet; and a filtration system connected to the air outlet of the separation cyclone.

24. The apparatus of claim 23, wherein the filtration system comprises a demister and a bag house.

25. The apparatus of claim 23, wherein the filtration system comprises a venturi wet scrubber.

26. The apparatus of claim 23, wherein the filtration system comprises:

a container body having an container inlet disposed in a middle portion and an air exhaust disposed in an upper portion;

a de-mister disposed in the container body between the container inlet and the air exhaust;

a venturi connection disposed between the air outlet of the separation cyclone and the container inlet;

a fluid distributor disposed adjacent the venturi connection.

27. A method for comminuting materials, comprising:

providing air flow from a blower having a blower output connected to an input of a comminution/drying cyclone;

supplying materials through a material feed connected to the input of the comminution/drying cyclone;

transporting comminuted materials to a separation cyclone having an inlet connected to an output of the comminution cyclone;

filtering air from an air outlet of the separation cyclone, wherein the air from the air outlet of the separation cyclone is filtered through a venturi wet scrubber; and discharging separated materials through a material discharge of the separation cyclone.

* * * * *

UNITED STATES PATENT AND TRADEMARK OFFICE

CERTIFICATE OF CORRECTION

PATENT NO. : 6,530,534 B1
DATED : March 11, 2003
INVENTOR(S) : Farmer

It is certified that error appears in the above-identified patent and that said Letters Patent is hereby corrected as shown below:

Column 1,
Line 5, please change “06/153,210” to -- 60/153,210 --.
Line 13, please change “system” to -- systems --.

Column 2,
Line 13, please change “utilizes” to -- utilize --.

Column 4,
Line 22, please change “fore” to -- force --.

Column 8,
Line 29, please change “an” to -- a --.

Signed and Sealed this

Fifth Day of August, 2003

JAMES E. ROGAN
*Director of the United States Patent and Trademark Office*